US008684593B2

(12) United States Patent
Moser et al.

(10) Patent No.: US 8,684,593 B2
(45) Date of Patent: Apr. 1, 2014

(54) STATIC MIXER HAVING A VANE PAIR FOR THE GENERATION OF A FLOW SWIRL IN THE DIRECTION OF A PASSAGE FLOW

(75) Inventors: Felix Moser, Neftenbach (CH); Sabine Sulzer Worlitschek, Winterthur (CH); Joachim Schoeck, Winterthur (CH)

(73) Assignee: Sulzer Chemtech AG, Winterthur (CH)

( * ) Notice: Subject to any disclaimer, the term of this patent is extended or adjusted under 35 U.S.C. 154(b) by 864 days.

(21) Appl. No.: 12/227,264

(22) PCT Filed: Jun. 12, 2007

(86) PCT No.: PCT/EP2007/055744

§ 371 (c)(1),
(2), (4) Date: Nov. 10, 2008

(87) PCT Pub. No.: WO2008/000616

PCT Pub. Date: Jan. 3, 2008

(65) Prior Publication Data

US 2009/0103393 A1 Apr. 23, 2009

(30) Foreign Application Priority Data

Jun. 27, 2006 (EP) ..... 06116121

(51) Int. Cl.
*B01F 5/04* (2006.01)

(52) U.S. Cl.
USPC ..... 366/336; 366/337; 366/338

(58) Field of Classification Search
CPC ..... B01F 5/0451
USPC ..... 366/336
See application file for complete search history.

(56) References Cited

U.S. PATENT DOCUMENTS

| | | | |
|---|---|---|---|
| 3,381,713 | A | 5/1968 | Jacobsen |
| 4,099,268 | A | 7/1978 | Luthi |
| 5,971,603 | A | 10/1999 | Davis |
| 2002/0085448 | A1 | 7/2002 | Phillips |

FOREIGN PATENT DOCUMENTS

| | | | |
|---|---|---|---|
| DE | 25 08 665 | A1 | 9/1976 |
| DE | 43 25 977 | A1 | 2/1995 |
| DE | 295 21 184 | U1 | 10/1996 |
| DE | 195 39 923 | | 6/1997 |
| DE | 19539923 | * | 6/1997 |
| EP | 0 604 116 | A | 6/1994 |
| JP | 53 037952 | A | 4/1978 |
| JP | 56 147619 | | 11/1981 |
| JP | 2004-141701 | A | 5/2004 |
| JP | 2004-195452 | A | 7/2004 |

* cited by examiner

*Primary Examiner* — Yogendra Gupta
*Assistant Examiner* — Alison Hindenlang
(74) *Attorney, Agent, or Firm* — Francis C. Hans; Carella, Byrne, et al.

(57) ABSTRACT

The static mixer (1) includes at least one vane pair (2; 2*a*, 2*b*) for the generation of a flow swirl (300) in the direction (30) of a passage flow (3). Edges of the vanes at the front at the leading side are perpendicular to the passage flow and parallel to a height of the passage (10). Onflow surfaces following downstream are bent out in a concave manner and in opposite senses. Each vane (2*a*, 2*b*) is formed as an aerodynamically designed body which includes an end wall (20), a convex side wall (21) and a concave side wall (22). The end wall has a convex shape or a shape of a leading edge. The vane cross-sections perpendicular to the side walls in particular have similar shapes to cross-sections of aeroplane wings.

13 Claims, 2 Drawing Sheets

Figure 1:
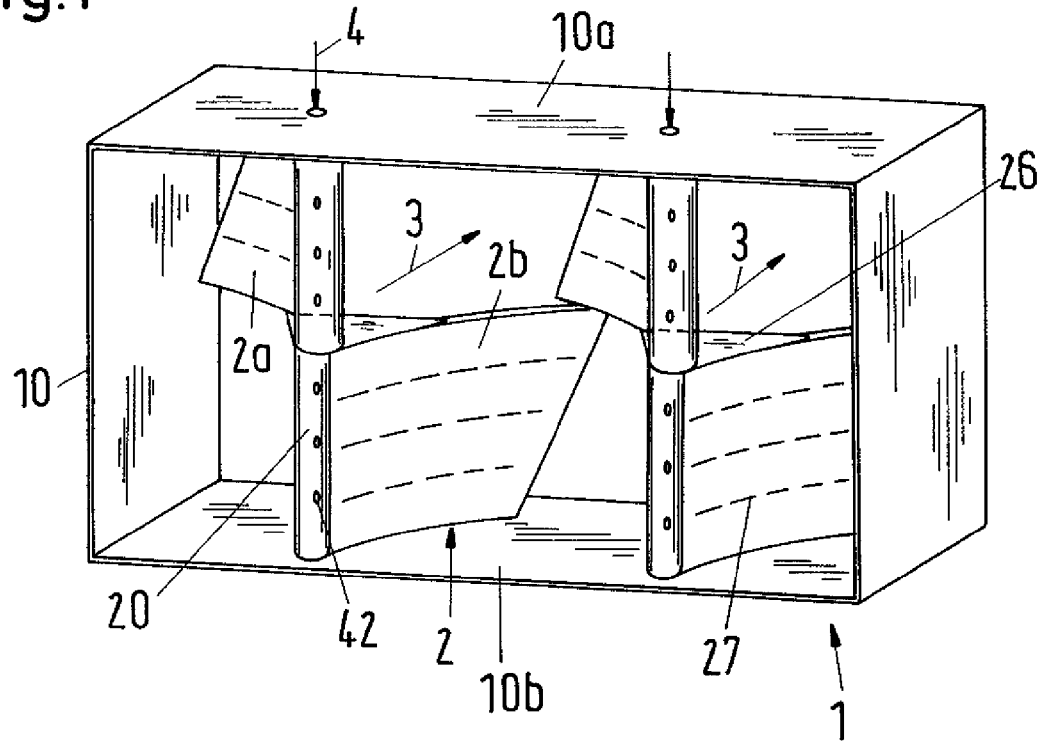

STATIC MIXER HAVING A VANE PAIR FOR THE GENERATION OF A FLOW SWIRL IN THE DIRECTION OF A PASSAGE FLOW

The invention relates to a static mixer having at least one vane pair for the generation of a flow swirl in the direction of a passage flow in accordance with the preamble of claim 1. This vane pair is a vortex-inducing static mixer element. Such a vane pair or a plurality of vane pairs which are arranged next to one another on a cross-section in a passage, in particular a rectangular passage, forms a vortex-inducing static mixer. As a rule, the vane pairs are arranged next to one another on a "tier"; they can, however, also be arranged next to one another and over one another in grid-like manner on two or more "tiers".

A secondary fluid should, for example, be mixed into a primary fluid using the vortex-inducing static mixer element. In this connection, the primary fluid can be a waste gas containing nitrogen oxides in which a denitrification is to be carried out by means of a catalyst in a DeNOX plant, with the secondary fluid being metered in as an additive in the form of ammonia or of an ammonia/air mixture. A mixing of the secondary fluid into the primary fluid can be achieved with the required homogenisation with small pressure loss using an apparatus known from DE-A-195 39 923 C1, a static mixer for a passage flow. A homogenisation only in the form of a temperature and/or concentration balance can also be carried out with the vortex-inducing static mixer element.

In the known apparatus, at least two vortex-generating areal vanes are arranged in a passage flowed through by the fluids such that a generation of a swirl is enforced in the direction of the passage flow, the main flow direction. Edges of the vanes at the front at the leading side are fastened to a tube which is perpendicular to the main flow direction and parallel to a height (or shorter side) of the passage. This fastening tube connects a lower passage wall to an upper one. The additive metering can be integrated in the tube. The secondary fluid fed into the tube can be distributed into the primary fluid by a plurality of nozzles. The two vanes are offset with respect to one another and attached to the fastening tube in V shape. Starting from the front edges, the vanes are bent out in opposite senses so that they have a concave surface at the leading side. The vane cross-sections along the main flow direction have a variable longitudinal extent and a variable alignment. Due to the special shape, the swirl is created in the passage flow which effects a mixing over the total passage height in the form of a primary vortex.

It has been shown, that a solution, according to which the vanes are formed from thin-walled sheet metal is technically not practicable in particular for mixers with large dimensions in the range of a couple of meters, as they are common in DeNOX plants of power stations, waste incinerating plants or the like as has been shown in DE 195 39 923 C1. This has several reasons: on one hand, such vanes are very easily deformable, so that their manufacture according to the specified dimensions is nearly impossible. The transport and in particular the assembly of such a mixer in a large flow channel, for example in a flue gas channel, which usually takes place on the construction site under rough conditions, consequently requires costly precautions. Moreover, it has been shown in material strength calculations, that the vanes, which are in operation subjected to flowable media of high velocity and large turbulence, tend to vibrations when such a soft construction is used. Such vibrations can lead to serious damages and therefore have to be avoided under all circumstances.

In order to avoid these problems associated with the prior art, the vanes should according to the prior art be made from thick-walled sheet metal, that means with sheet metal wall thicknesses of a couple of millimeters. Such a sheet metal wall thickness causes numerous manufacturing problems, due to the fact that such a thick-walled sheet metal in the required dimension and geometry is nearly not mechanically workable, in particular rollable. A further disadvantage to be considered, is the high material consumption for the vanes made from thick-walled sheet metal, in particular if the length of the vanes is in the region of one or more meters. This material consumption leads on one hand to high material costs. On the other hand, the high material consumption leads to a large weight static mixer, as the mixer is mounted into large flue gas channels. Such flue gas channels habitually consist of thin-walled sheet metal and as a consequence the walls made of such thin-walled sheet metal have a limited support function. For the mounting of such a heavy mixer, the flue gas channels have to be reinforced by complicated additional support constructions.

An additional, however at its own insufficient, possibility of adding stiffness to the vanes according to the prior art is also shown in the DE 195 39 923 C1, In this advantageous embodiment, a gusset plate standing perpendicular to the tube connects the two surfaces of the vane pair. The gusset plate serves both for aerodynamic stabilisation and for mechanical stabilisation. However, this added stiffness for is not suitable for vanes for flue gas channels of a large cross-section, due to the fact that the free side edges of the vanes lying opposite the gusset plate can not be stiffened by this measure and consequently the undesired vibrations of the vane due to the vortices induced by the flue gas flow persist, as described in the following.

A plurality of vane pairs induces a corresponding number of primary vortices which permit a global mixing in of an additive over the passage cross-section. In this connection, the respective sense of rotation of the primary vortices is fundamental. Adjacent vortices which rotate in the same sense join up to form a roll which extends over the active regions of the vane pairs inducing these vortices. If the vortices have opposite senses, a better mixing results in the individual active regions; however, at the costs of the global mixing. In this case, a mixing coupling can be generated between the adjacent vortices by means of additional guide elements (cf. DE-A-195 39 923) for the improvement of the global mixing.

In addition to the primary vortices, secondary vortices are also formed, namely behind the fastening tube and at the free edges of the areal vanes. The secondary vortices can admittedly contribute to a local mixing, but effect pressure losses and unwanted vibration effects. It would be advantageous if the occurrence of secondary vortices could be prevented at least in part.

It is the object of the invention to provide a vortex-inducing static mixer which is improved with respect to pressure losses and vibration effects. This object is satisfied by the mixer defined in claim 1.

The static mixer includes at least one vane pair for the generation of a flow swirl in the direction of a passage flow. Edges of the vanes at the front at the leading side are perpendicular to the passage flow and parallel to a shorter side of the passage which is called the height in short form in the following. Onflow surfaces following downstream are bent out in a concave manner and in opposite senses. Each vane is formed as an aerodynamically designed body which includes an end wall, a convex side wall and a concave side wall. The end wall has a convex shape or a shape of a leading edge. The vane cross-sections perpendicular to the side walls in particular have similar shapes to cross-sections of aeroplane wings.

Dependent claims 2 to 10 relate to advantageous embodiments of the mixer in accordance with the invention.

Figure 2:
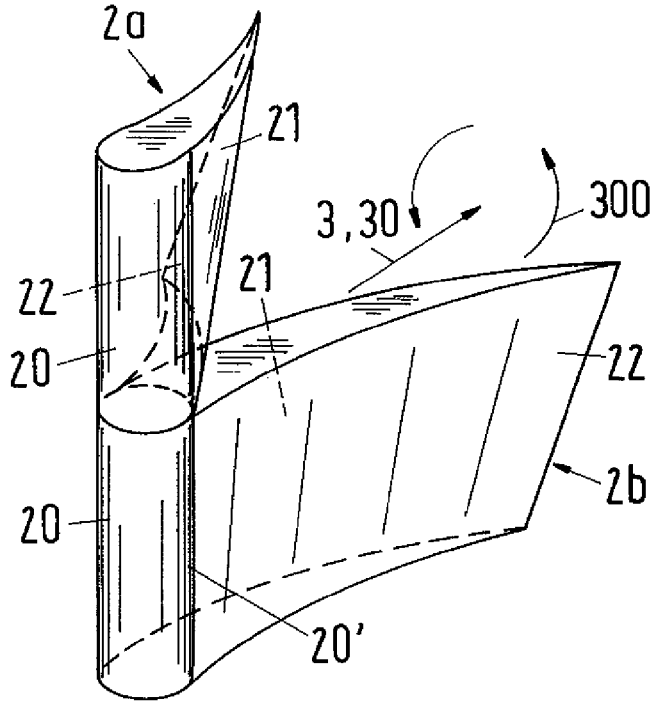
Figure 3:
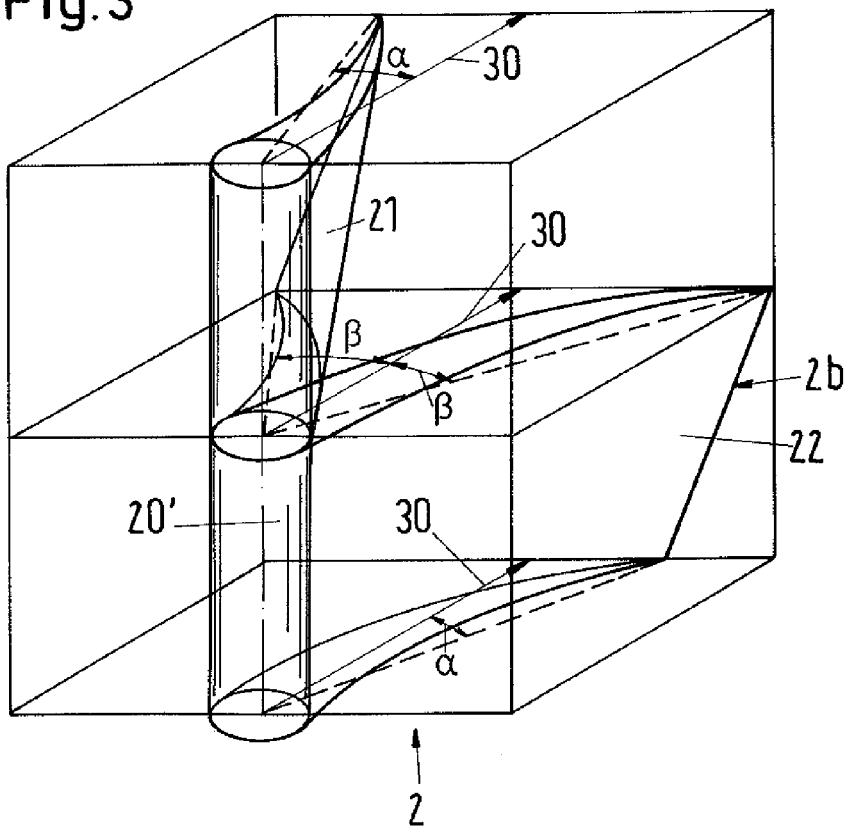

The invention will be explained in the following with reference to the drawings. There are shown:

FIG. 1 a mixer in accordance with the invention;

FIG. 2 a vane pair of this mixer in a somewhat simplified representation;

FIG. 3 a transparent representation of the vane pair of FIG. 2; and

Figure 4:
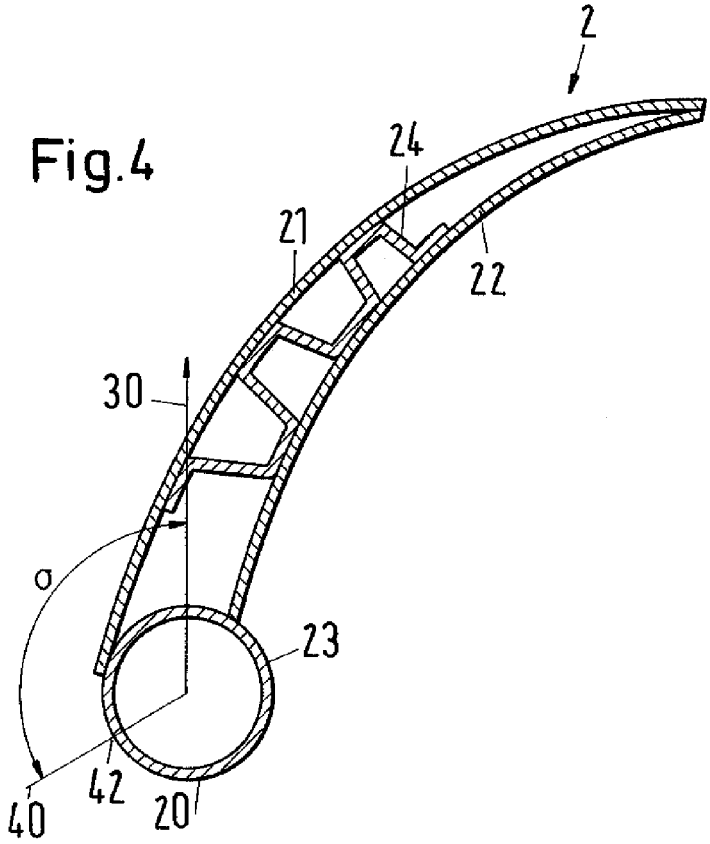

FIG. 4 a cross-section through a vane.

A mixer 1 in accordance with the invention such as is shown with reference to FIGS. 1 to 4 includes at least one vane pair as a mixer element 2 with which a flow swirl 300, whose axis faces in the direction of the passage flow 3, is generated in a passage flow 3 in a passage 10. An upper side 10*a* and a lower side 10*b* of the passage 10 define the height of the passage 10. The vane pair 2 includes a first vane 2*a* and a second vane 2*b*. The edges of the vanes 2*a*, 2*b* at the front at the leading side are perpendicular to the passage flow 3 and parallel to the height of the passage 10. The vanes 2*a* and 2*b* have onflow surfaces or vane walls 22 which follow the front edges downstream and which are bent out in a concave manner and in opposite senses. The axis of the passage 10 defines the main flow direction 30 (FIG. 3) of the passage flow 3 in which the swirl 300 faces.

In accordance with the invention, each vane 2*a*, 2*b* is made as an aerodynamically designed body which includes an end wall 20, a convex side wall 21 and the concave side wall 22. The vane cross-sections transverse to the side walls 20, 21, 22 have a variable alignment and a longitudinal extent. They in particular have a shape which is similar to cross-sections of aeroplane wings. The alignment of the vane cross-section varies between an angle $\alpha$ and an angle $\beta$, as is shown in FIG. 3. In this connection, $\alpha$ is advantageously smaller than $\beta$. The convex end wall 20 is an elongate cylinder 20' or a tube 23 in the embodiment shown (FIG. 4). Gussets 26 (FIG. 1) produce an improved mechanical stability of the vane pair 2. The end wall 20 has a convex shape in the embodiment shown; however, it can also be shaped such that it forms a special leading edge on which dust particles cannot be deposited or can only be deposited to a very limited degree.

The vanes 2*a*, 2*b* of the mixer element 2 form bodies in the form of lightweight constructions; they are in particular hollow bodies. The side walls of the vanes 2*a*, 2*b* are advantageously made of thin sheet metal whose thickness is, for example, 1 mm, but can also be smaller, for example 0.5 mm. Stabilising connection elements, for example corrugated sheet metal strips 24 (see FIG. 4), foamed bodies (not shown) or pillars, are arranged between the inner sides of the side walls 2*a*, 2*b*. In FIG. 1, pillars are shown as dashed lines 27.

The vanes 2*a*, 2*b* made as lightweight constructions can be made such that, with a vane height of one metre (or also more), they lack natural vibrations whose frequencies lie within the range from 1 to 10 Hz. The natural vibrations lying outside this range are not excited by the passage flow 3; in particular, no so-called flag oscillations are excited. ("Flag oscillation" is a flow-induced oscillation which is comparable to the movement of a flag fluttering in the wind). Thanks to the aerodynamic shape of the vanes, during the inflow, the passage flow 3 enters into a region of the static mixer elements in which the flow cross-sections between the vanes reduces continuously. In this connection, an enlarging of the kinetic energy of the flow corresponds to a pressure drop. The flow cross-sections subsequently expand in the manner of a diffuser. In this connection, the pressure can increase again without any substantial dissipation of the kinetic energy. The reduced dissipation means that only weakly formed secondary vortices are created by which, for example, no flag oscillations are excited. The vanes 2*a*, 2*b* are stiffened by the lightweight constructions such that an excitement of oscillations is also either fully absent due to changed mechanical properties or is at least shifted towards higher and so non-critical oscillation frequencies.

In the quoted DE-A-195 39 923, the use of thin-walled bodies, in particular those of sheet metal or plastic, is set forth for a possible construction form of the mixer elements. This embodiment is unsuitable for the construction of large mixers (from a passage height of 1 or 2 m onward) such as are frequently used in DeNox plants due to demands on strength and stability. This problem is eliminated by the mixer elements 2 of the mixer 1 in accordance with the invention.

No outlying stiffening structures, for example ribs, are required either which unfavourably influence the flow field along the vane surfaces or effect dust deposits and thereby impair the action of the mixer 1.

An additive metering can be carried out in a known manner by means of a dosing grid which is arranged in front of the mixer elements 2 in the passage 10. However, large cost savings result when the additive metering is integrated in the mixer elements 2, such as is already provided in DE-A-195 39 923. In contrast to this known form of additive metering, in which nozzles are arranged directly at the base of the vanes, it has proved to be more advantageous to provide discharge openings with a respective infeed of the additives whose infeed direction faces toward or transversely to the direction of flow. Such a measure not only has the consequence of a better mixing effect, but the infeed is also less sensitive to a non-uniform onflow. Openings 42 in the end wall 20 or to the side in the vicinity of the end wall 20 are therefore provided as discharge openings of the integrated additive metering. The openings 42 are nozzles, bores or orifices cut by lasers which can, for example, be round, rectangular or of slit-shape. The additive to be metered is a secondary fluid 4 (FIG. 1) which is to be mixed into the primary fluid formed through the passage flow 3. The openings 42 each define an infeed direction 40 of the secondary fluid 4 which defines a discharge angle $\sigma$ with respect to the main flow direction 30. This discharge angle $\sigma$ has a favourable value which lies in the range between 60 and 170°, preferably between 120 and 150°. CFD ("computational fluid dynamics) studies with model calculations have produced an optimum value for $\sigma$ of 142.5°. The integrated additive metering can also include openings for the secondary fluid 4 which are arranged in the side walls 21 and 22.

The openings 42 of the additive metering are arranged at intervals at levels which have been optimised theoretically or empirically with respect to model calculations or trials. They are, for example, arranged in pairs and in specular symmetry with respect to the axis of the swirl 300. As a rule, however, all or most of the openings 42 are located at different levels which can have different intervals.

The openings 42 can be connected to a delivery line for the additive or the additive is delivered directly to the hollow body of the vane section.

In a particularly advantageous embodiment, the side walls 21, 22 of the vane pair 2 are connected by a gusset plate (no drawing representation), such as is known from DE-A-195 39 923, which is perpendicular to the tube. If the gusset plate is triangular in shape with straight sides, edges project beyond the concave side walls 22. An improved mixing effect is achieved with such projecting edges of the gusset plate without an increase in pressure loss occurring.

The vane walls 21, 22 are at made at least partly of metal, ceramic material and/or plastic. A metallic mixer element 2 can be coated with a ceramic material or plastic.

The use of the mixer in accordance with the invention is particularly advantageous when the height (shorter side) of the passage 10 is larger than 0.5 m, preferably larger than 1 m. The mixer elements 2 (vane pairs) advantageously extend beyond the height of the passage 10, with them being arranged on a tier. In this case, the number of mixer elements 2 is consequently substantially the same as the quotient of passage width to passage height. Typical values for this number are in the range from 2 to 8. Depending on the number of mixer elements 2, a large number of—more or less efficient—arrangement variants result: for example all mixer elements 2 rotating alternately or in the same sense. It is thus possible to optimise the arrangement of the mixer elements 2 for an object which results with respect to an unequal distribution of temperature or concentrations given as the starting condition in a situation. The vane pairs 2 can also be arranged on two or more "tiers" instead of one "tier", with the "tiers" as a rule not being separated from one another by walls.

The invention claimed is:

1. A static mixer comprising at least one vane pair for the generation of a flow swirl in the direction of a passage flow having at least two vanes whereby each vane is made as an aerodynamically designed hollow body, comprising an end wall, a convex side wail and a concave side wall characterised in that the end wall has the shape of a leading edge so that the leading edges of the vanes of a vane pair extend perpendicularly to the passage flow and coaxial of each other and whose onflow surfaces following downstream are bent out in a concave manner and in opposite senses with the end wall having a convex shape or the shape of a leading edge and the vanes form bodies in the form of lightweight constructions.

2. A static mixer in accordance with claim 1, wherein cross-sections arranged perpendicular to the side walls have similar shapes to cross-sections of aeroplane wings.

3. A static mixer in accordance with claim 1, characterised in that the side walls of the vanes are made from thin sheet metal of a thickness of from 0.5 to 1 mm; and in that stabilising connection elements are arranged between the inner sides of the side walls, with the connection elements being formed by at least one of pillars, corrugated sheet metal strips and foamed bodies.

4. A static mixer in accordance with claim 1 characterised in that said lightweight constructions have natural oscillations whose frequencies are outside the range of 1 to 10 Hz so that no oscillations can be excited in this frequency range by the passage flow and no so-called flag oscillations occur.

5. A mixer in accordance with claim 1 characterised in that a plurality of openings of an integrated additive metering are arranged in the vane walls with the additive to-be metered being a secondary fluid which is to be mixed into a-primary fluid forming the passage flow.

6. A static mixer in accordance with claim 5, characterised in that said end wall is a tube with said openings therein and further comprising a gusset plate perpendicular to said tube and connecting said side walls of the vane pair and projecting beyond said concave side walls to achieve an improved mixing effect.

7. A static mixer in accordance with claim 6, characterised in that said openings define infeed directions of the secondary fluid which define discharge angles with respect to the main flow direction and in that these discharge angles have a value which lies in the range between 60 and 170°.

8. A static mixer in accordance with claim 5 characterised in that the openings are arranged at intervals-at levels which have been optimised with respect to one of model calculations or trials.

9. A static mixer in accordance with claim 1 characterised in that the vane walls are made at least partly from metal, ceramic material and/or plastic.

10. A static mixer in accordance with claim 1 characterised in that the shorter side of the passage is larger than 0.5 m; and in that the vane pairs are arranged in at least one of a tier, with said vanes extending beyond the shorter side of the passage; and in two or more tiers.

11. A mixer element for a static mixer comprising a pair of hollow vanes for generating a flow swirl in a direction of a passage flow, each said vane having a first end wall defining a leading edge and disposed in alignment with the end wall of the other vane, a convex side wall extending from said first end wall and a concave side wall extending from said first end wall opposite to and spaced from said convex side wall, each said convex side wall and said concave side wall being bent in a concave manner transversely thereof and in opposite senses with respect to each other.

12. A mixer element as set forth in claim 11 where each said end wall has a convex shape at a leading edge thereof.

13. A mixer element as set forth in claim 11 further comprising connection elements connecting said convex side wall and said concave side wall together.

* * * * *